United States Patent [19]

Ritter

[11] 4,102,612

[45] Jul. 25, 1978

[54] REVERSIBLE ROLLER PUMP WITH LONGER HOSE WEAR

[76] Inventor: Wilhelm F. K. G. Ritter, Gothaestrasse 3, Kaltenkirchen, Fed. Rep. of Germany, 2358

[21] Appl. No.: 702,877

[22] Filed: Jul. 6, 1976

[30] Foreign Application Priority Data

Jul. 5, 1975 [DE] Fed. Rep. of Germany ..... 2530149

[51] Int. Cl.[2] ..... F04B 43/08; F04B 43/12; F04B 45/06

[52] U.S. Cl. ..... 417/477; 417/479; 417/480

[58] Field of Search ..... 417/477, 476, 475, 474, 417/478, 479, 480; 251/6, 9; 138/118, 119; 222/213, 214

[56] References Cited

U.S. PATENT DOCUMENTS

| | | | |
|---|---|---|---|
| 2,123,781 | 7/1938 | Huber | 417/476 |
| 2,784,902 | 3/1957 | Glenn | 417/479 |
| 2,794,400 | 6/1957 | Bodine | 417/476 |
| 3,176,622 | 4/1965 | Pfeiffer | 417/477 |
| 3,565,554 | 2/1971 | Muller | 417/477 |
| 3,687,580 | 8/1972 | Griffiths | 417/477 |
| 3,829,251 | 8/1974 | Schwing | 417/477 |

FOREIGN PATENT DOCUMENTS

| | | | |
|---|---|---|---|
| 6,243 | 8/1878 | Fed. Rep. of Germany | 417/477 |
| 2,132,193 | 1/1973 | Fed. Rep. of Germany | 417/477 |
| 341,261 | 11/1959 | Switzerland | 417/477 |

*Primary Examiner*—Carlton R. Croyle
*Assistant Examiner*—Thomas I. Ross
*Attorney, Agent, or Firm*—Andrus, Sceales, Starke & Sawall

[57] ABSTRACT

A pump has a flexible hose mounted in a partially circular housing. The hose is traversed by a rotating roller assembly to provide the pumping action. The hose may be formed with pair a of thickened parallel walls joined by deflectable outer sections. The walls may contain inner grooves for receiving the fluid being conveyed as a lubricant and reinforcing rods connected to an external chain. A tilting valve, operated by the action of the rollers, may be positioned on either end of the hose.

12 Claims, 7 Drawing Figures

REVERSIBLE ROLLER PUMP WITH LONGER HOSE WEAR

BACKGROUND OF THE INVENTION - FIELD OF THE INVENTION

The invention is directed to a flexible hose pump having rotating rollers, in which a hose, arranged in a partial circular housing wall portion, is sequentially, transversely compressed in a contact area.

In such a hose pump, the length of the partial circle is selected to correspond with the number of rollers to sequentially produce, in all phases of the rotation, a closed hose chamber. In the arrangement of two rollers, the partial circle corresponds, in form to a semi-circle, in the course of the operation of an arrangement of three rollers displaced at similar angles with respect to each other, a partial circle in the form of a third of a circle suffices.

With existing flexible hose pumps of this type, it is known to employ flexible hoses having a circular formed cross-section. A shortcoming of this known arrangement is that the hoses are exposed to considerable abrasion in the compression resulting from the passage of the rollers. This wear occurs because, by the squeezing action of the compression, both the outerlying hose walls as well as the inner-lying hose walls, are exposed to tension and tangential stresses. The inner-lying hose walls are moved through the rollers by their passage in a direction toward the discharge side, specifically, the rollers attempt to move the inner-lying hose walls in the direction of the discharge side, whereby these hose walls, in the portion lying in front of the rollers, are compressed and, in the portion following the rollers, are stressed in tension. In a corresponding manner, the outer hose walls are stressed in the contact region. The stresses take effect very strongly and are increased by the moment resulting from the difference between the hose inner diameter and the hose outer diameter. This moment is relatively large in a hose with a circular cross-section. A further disadvantage of the known hose pumps is that with a discharge delivery at the discharge or pressure side after the raising of the respective roller from the hose inner wall, the hose chamber formed between the two rollers opens to the pressure side, so that a part of the pressurized advancing fluid can run back in the rear end of the chamber enlarged through the raising of the roller. This results in non-uniform delivery and disadvantageous vibrations.

SUMMARY OF THE PRESENT INVENTION

The invention is thus directed to a flexible hose pump of the previously referred to type which is so formed that wear as well as wear producing vibrations are diminished as much as possible.

This object is, through the invention, attained in that the hose, at least in the partial circular region includes, in cross-section, a middle section with parallel side walls and a central width corresponding to the rollers and has two outer sections connected to the parallel walls of the middle section, whereby the outer sections are formed through walls which are at an angle to each other and permit compression by deflection.

With such an arrangement it is attained that the pair of parallel walls of the middle section are moved parallel to each other through the passage of the rollers, whereby on the basis of its parallel position, the wall is established adjacent the housing and does not, as with known hoses of circular formed cross-section, is disadvantageous and wear producing ways lift off the housing. Further, the inventive arrangement has the advantage that the moment of both parallel walls with respect to each other can be held essentially smaller than with known hoses so that the milling action in the outer sections is also reduced.

A hose pump of the initially described type with a hose of circular formed cross-section is, indeed, known by which the walls of the flexible hose are provided with recesses located in those places, in which with the flat compression of the hose the curvatures are retained. These small recesses have, however, simply the purpose to permit the hose surfaces in the compressed condition to lie tightly on one another and to avoid leaks in the curved area. The advantages of the invention are not attainable with these known arrangements.

It is advantageous for the pair of parallel walls to have a greater wall thickness than the outer sections so that thereby, on the one hand, a secure attachment on the housing wall is possible and, on the other hand, an arrangement for additional reinforcement, as explained below, is possible. Further, the greater thickness of the walls of the middle section has the advantage that with the parallelism of the walls, the stroke movement is also stopped and thereby the deformation action is almost exclusively transferred thereon to the outer sections with smaller wall thickness.

The milling action inside the parallel walls is obviously not entirely precluded, however with the turning of the pressure rollers and the opposing pressure of the parallel walls only, a limited deformation in the material of the rubber hose appears.

It is advantageous to diminish the rolling friction abrasion arising by the passage of the rollers and the hose deformation relative movement between the hose outer walls and the hose inner walls by cross grooves provided in at least the inner side of the parallel walls. These cross grooves receive the fluid being conveyed and serve as a lubricating means for rolling friction reduction.

As a result of the parallelism of the pair of walls of the middle section and by virtue of the larger wall thickness, it is possible, at least in the inner walls of the middle section to introduce the bars of a chain as reinforcement, thereby to diminish the elongation and shortening of the hose inner wall. Also, the vibration phenomena, compared with known apparatus, is thereby greated reduced.

To avoid the disadvantageous back flow of the transported medium a tilting valve is arranged, in an advantageous manner in the hose ends. The tilting valve is introduced in the hose wall and on an axis arranged in the hose inner side tilts. In this manner the tilting valve is actuated through the withdrawing rollers in the closing direction and prevents a return flow of the transported fluid by the withdrawal of the rollers. For dependable operation, the axis of the tilting valve may be provided with at least one lateral lever which is in connection with the end of the chain.

It is also advantageous to arrange such a tilting valve on both of the hose ends because thereby first the hose pump can run in both directions and because, also, on suction can the above-described disadvantageous phenomena appear.

BRIEF DESCRIPTION OF THE DRAWINGS

The invention is more specifically explained in the following by means of the exemplary embodiments of the drawing.

DETAILED DESCRIPTION OF PREFERRED EMBODIMENT

Figure 1:
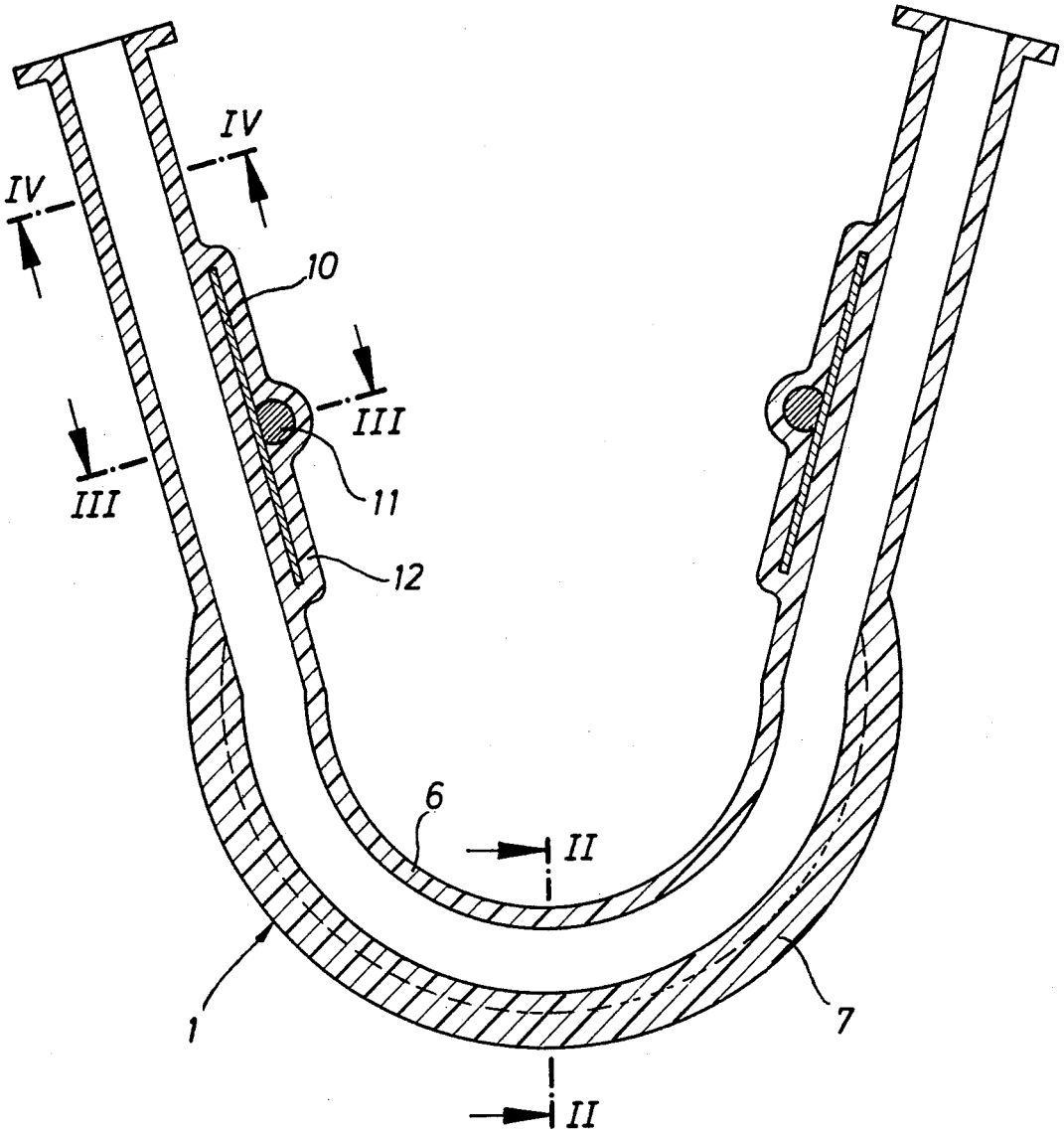
FIG. 1 shows in section a hose for a hose pump formed according to the invention.
Figure 2:
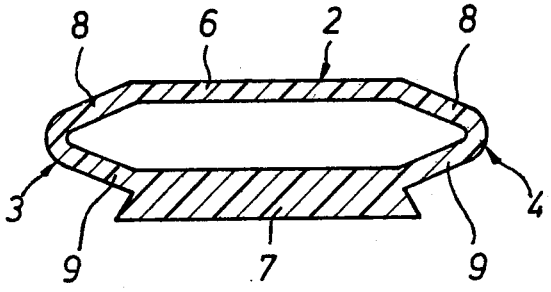
FIG. 2 is the section II—II of FIG. 1.

As shown in FIGS. 1 and 2, hose 1 includes, in the partial circular portion, a middle section 2 having a cross-sectional central width B (see FIG. 6) corresponding to rollers 5 (see FIG. 6) to which is connected outer sections 3 and 4. The middle section is formed out of parallel walls 6 and 7, whereby sections 3 and 4 are formed by walls 8 and 9 which lie at an angle to each other to permit compression. The outer sections 3 and 4 connect the parallel walls 6 and 7. Also as shown in FIG. 2, in an advantageous manner, parallel walls 6 and 7 can have a greater wall thickness than walls 8 and 9 of outer sections 3 and 4. With the exemplary embodiment according to FIGS. 1 through 4, only the wall 7 adjacent the housing inner wall has a greater cross-section than the walls of the outer sections 3 and 4. This wall can be formed in a dove-tailed shape to provide the positioning of the hose portion in the housing wall (see FIG. 6).

Figure 3:
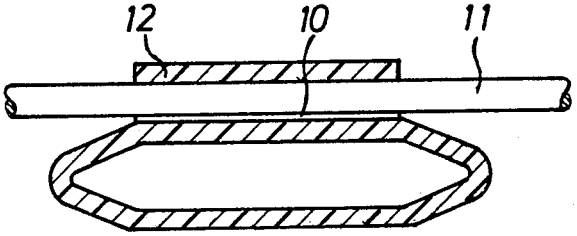
FIG. 3 is the section III—III of FIG. 1.
Figure 4:
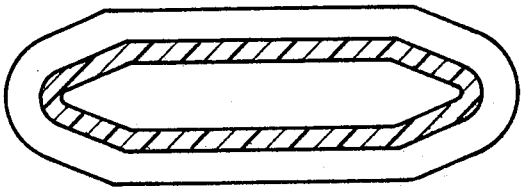
FIG. 4 is the section IV—IV according to FIG. 1.

FIG. 3 is the section III—III of FIG. 1 and permits illustration, in connection with the section of FIG. 1, of the arrangement of tilting, or flap, valve 10 which is located within the hose material. The hose material is provided with a thickened wall 12 in this area for the mounting of the tilting valve 10 and the axle 11 within the hose material.

Figure 5:
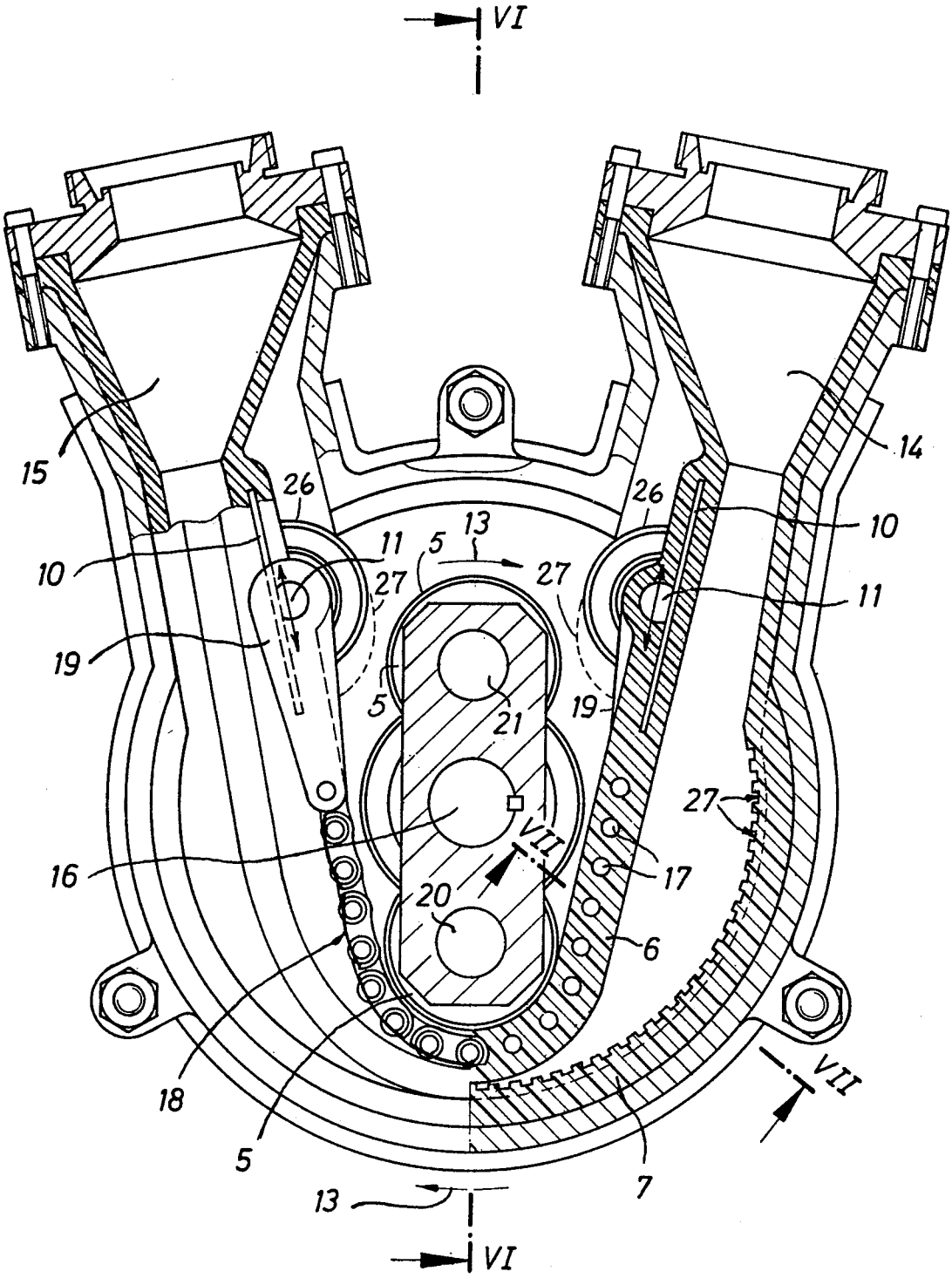
FIG. 5 shows a somewhat modified form of the hose of FIG. 1 arranged in a hose pump.

FIG. 5 shows, in partial section, an exemplary form of a hose pump provided with a hose in accordance with the invention, in which the hose is somewhat modified with respect to the illustration in FIG. 1.

As shown in FIG. 5, rotating rollers 5 are provided for rotation in the direction of arrows 13 which compress the hose by sectors and thereby form the pump chambers. By the rotation in the direction of the arrows 13 is the suction side 14 and the discharge side 15 formed. The rollers rotate about the axle 16.

With the exemplary embodiment according to FIG. 5, the walls 6 and 7 of the hose have, in the partial circular portion somewhat similar wall thickness, whereby the inner wall 6 of the middle section of the hose cross-section has the rods 17 (see also FIG. 7) of chain 18 introduced as reinforcement. In the illustrated exemplary embodiment the ends of chain 18 are in connection with levers 19 which are mounted on the axles 11 of the tilting valves 10. In this manner the lever is additionally actuated through its connection with chain 18 by the rotation of rollers 5 and the valve actuated in the described manner for the closure of the suction side and the pressure side.

With the illustrated exemplary embodiment, tilting valves 10 are arranged on both hose ends because thereby first the hose pump can run in both directions and because it further is thereby possible to close the hose chamber formed between the rollers both on suction and discharge.

Figure 6:
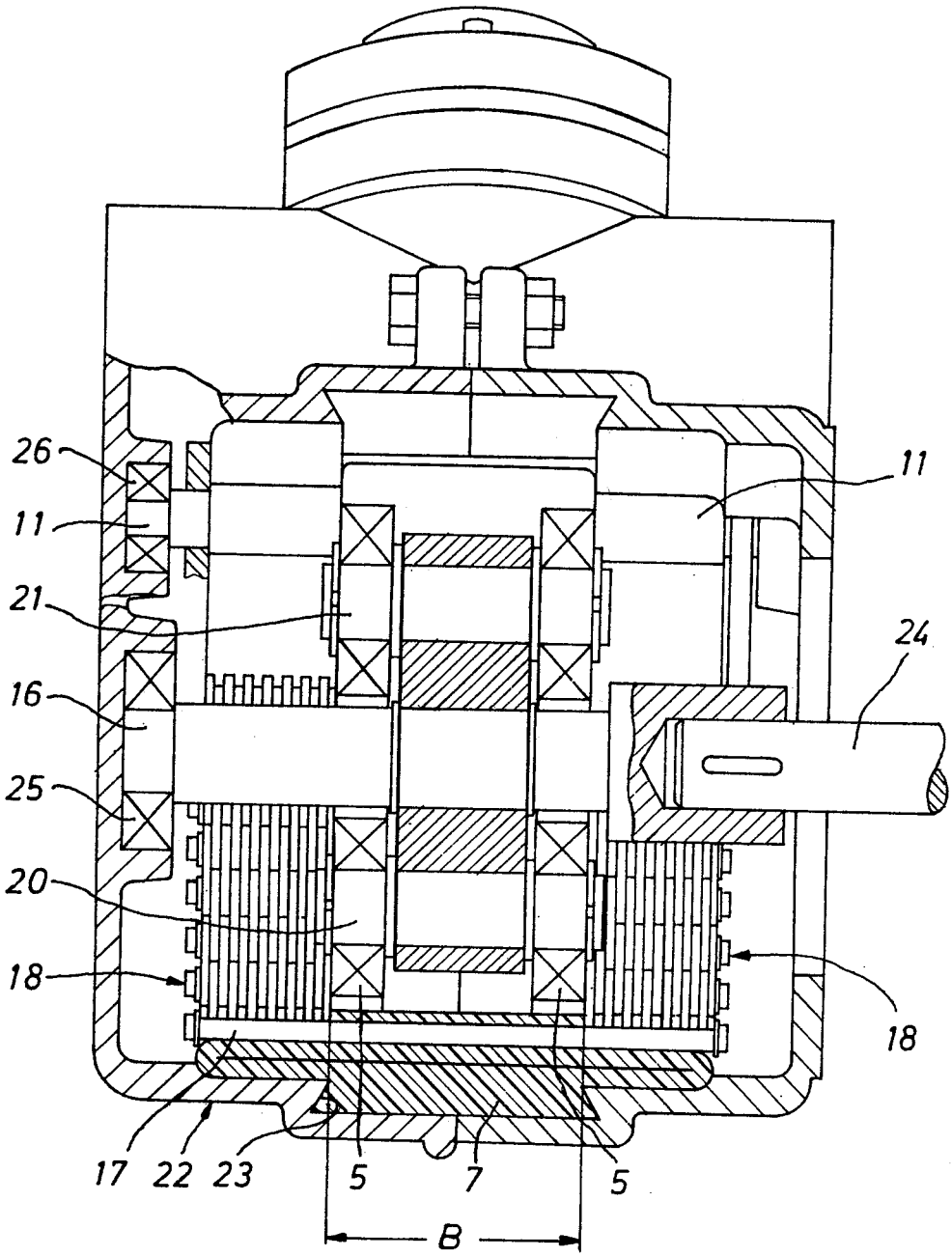
FIG. 6 is the section VI—VI of FIG. 5.

FIG. 6 is the section VI—VI of FIG. 5 and permits illustration of the two part construction of housing 22, which housing in its lower partial circular portion is similarly provided with a dove-tailed groove 23 for the mounting of the dove-tailed formed wall 7. The dove-tailed formed wall 7 can thereby be clamped between the pair of housing halves so that the hose outer wall is positioned in the housing 22.

The axles of rollers 5 are identified by the numerals 20 and 21 whereby in the illustrated exemplary embodiment the rollers are formed as ball bearings. As is apparent from FIG. 6, the chain with its links lies outside the axles 20 and 21 and outside the rollers 5. This is made possible by the introduced rods 17 of chain 18 since these rods pass the force of these rollers proportionately the same as the compressed hose cross-section.

The axle 16 is driven through the motor shaft 24 and is journaled on the opposite end from motor shaft 24 by means of ball bearings 25. FIG. 6 also shows the journalling of axle 11 by means of ball bearing 26.

Figure 7:
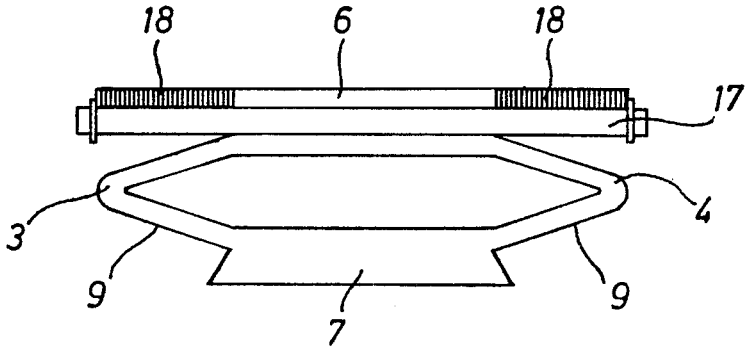
FIG. 7 is the section VII—VII of FIG. 5.

FIG. 7 is the section VII—VII through the hose according to FIG. 5 and permits illustration of the thickened configuration of the parallel walls for the incorporation of the chain rods 17 which extend over the outer sections 3 and 4. As shown in FIG. 6, in the compressed condition, the rods 17 lie on the outer surfaces of the abutting sections 3 and 4.

Finally, FIG. 5 shows the arrangement of the grooves 27 on the inner surface of the outer hose wall, whereby the grooves accommodate the advancing fluid and thereby serve as a lubricant means for rolling friction reduction.

In a preferred exemplary form of the hose pump according to the invention, the two tilting valves 10, axles 11 and bearings 26 are reciprocably movable with respect to the housing as by mounting the former in grooves 27 in the latter. The reason for this motion lies in that the hose, in certain positions of the transport elements 5, 20, 21, 16, will not be over-stretched, particularly with reference to a position in the range of approximately 45° and 135° with respect to the position of the transport elements shown in FIG. 5. Further, the thickness of the hose walls can thereby be increased, that the tilting valve be driven in the direction of the quiescent position of the hose walls 6 and 7 in the position of the transport elements shown in FIG. 5. To attain this, tilt valves 10 and axles 11 move symmetrically and in conformity with the rotation of the transport elements somewhat in the longitudinal direction of the valve longitudinal extension.

I claim:

1. A hose pump comprising:

a pump housing (22) having an inlet, an outlet, and an arcuate housing portion interposed therebetween;

a roller assembly rotatably journalled in said housing adjacent said arcuate housing portion, said roller assembly having rollers (5) spaced from said housing portion and sequentially passing along said housing portion when said assembly is rotated; and a flexible hose (1) interposed in the space between said roller assembly and said arcuate housing portion and having ends located in said inlet and outlet, said hose having an outer wall (7) in abutment with said arcuate housing portion and an inner wall (6) sequentially traversed by said rollers to compress it against said outer wall portion, said hose having, in a portion adjacent at least one of the hose ends, a valve flap (10) embedded in the wall of the hose, said flap being mounted on an axle (11) extending externally of said hose and journalled in said housing generally parallel to the axis of rotation of said roller assembly, said valve flap being tiltable with said axle for blocking said hose responsive to the traversing of said hose by said rollers.

2. The hose pump according to claim 1 wherein said hose inner and outer walls, at least in area traversed by said rollers, are parallel to each other and have a width (B) corresponding to the width of said rollers, said inner and outer walls being connected by bent side walls (3,4) which diverge toward said inner and outer walls and are deflectable upon compression of said inner wall by said rollers.

3. The hose pump according to claim 1 characterized in that in at least the portion of the inner wall (6) sequentially traversed by said rollers, rods (17) of a chain (18) are introduced as reinforcements, said rods extending through said wall in a direction parallel to the axis of rotation of said roller assembly and having ends exposed beyond said wall, exterior links connecting the exposed ends of adjacent rods for preventing longitudinal stretching of the hose in the reinforced portion.

4. The hose pump according to claim 3 further having lever means (19) coupled between the axle of said valve flap and the adjacent end of said chain (18) formed by said rods (17) and links for pivoting said axle and tilting said valve flap for blocking said hose responsive to the traversing of said hose by said rollers.

5. The hose pump according to claim 4 wherein the portions of said hose adjacent both ends have a valve flap-axle-lever means structure as defined in claim 4 and wherein the lever means (19) of each valve flap and axle is connected to a corresponding end of said chain (18).

6. The hose pump according to claim 4 wherein said tilting valve flap axles are journalled in said housing for reciprocal movement with respect thereto along the axis of the hose for relieving strain on the hose.

7. The hose pump according to claim 1 wherein said tilting valve flap axles are journalled in said housing for reciprocal movement with respect thereto along the axis of the hose for relieving strain on the hose.

8. The hose pump according to claim 1 wherein the portions of said hose adjacent both ends have a valve flap-axle structure as defined in claim 1.

9. The hose pump according to claim 2 characterized in that at least one of the parallel walls (7) provides a greater wall thickness than the side walls (3,4).

10. The hose pump according to claim 9 characterized in that both parallel walls (6,7) provide a greater wall thickness than the side walls (3,4).

11. The hose pump according to claim 9 characterized in that the outerlying wall (7) provides a dovetailed formed cross-section which is clamped in a dovetailed formed groove (23) in the pump housing (22).

12. The hose pump according to claim 2 characterized in that grooves (27) are arranged in at least one of the inner surfaces of the parallel walls (6,7).

* * * * *